United States Patent [19]

Jürgens

[11] Patent Number: 4,498,549

[45] Date of Patent: Feb. 12, 1985

[54] CUTTING MEMBER FOR ROTARY DRILL BIT

[75] Inventor: Rainer Jürgens, Altencelle, Fed. Rep. of Germany

[73] Assignee: Norton Christensen, Inc., Salt Lake City, Utah

[21] Appl. No.: 358,079

[22] Filed: Mar. 15, 1982

[30] Foreign Application Priority Data

Mar. 21, 1981 [DE] Fed. Rep. of Germany ..... 3111156

[51] Int. Cl.[3] ..... E21B 10/56

[52] U.S. Cl. ..... 175/329; 175/410

[58] Field of Search ..... 175/329, 330, 374, 375, 175/379, 409, 410–413; 51/309, 307, 295; 76/101 R, 101 A, 108 A, 108 R, DIG. 6, DIG. 8; 125/36, 39; 228/903, 263 A; 419/6, 18; 428/564, 565; 407/119

[56] References Cited

U.S. PATENT DOCUMENTS

| | | | |
|---|---|---|---|
| 1,538,028 | 5/1925 | Davis | 76/101 A |
| 2,686,663 | 8/1954 | Bruestle | 175/410 |
| 3,143,177 | 8/1964 | Galorneau et al. | 175/413 |
| 4,200,159 | 4/1980 | Peschel et al. | 175/329 |
| 4,221,270 | 9/1980 | Vezirian | 175/410 |
| 4,373,410 | 2/1983 | Davis | 175/374 |

*Primary Examiner*—James A. Leppink
*Assistant Examiner*—Hoang C. Dang

[57] ABSTRACT

A cutting member for rotary drill bits for deep-well drilling in ground formations consists of a carrier member (1) with a supporting surface (3) and a supporting member (4) of hard metal rigidly connected to this at its back and with a cutting layer (5) of polycrystalline synthetic diamond material. The supporting member (4) together with its cutting layer (5) is cut out of a circular cylindrical shaped body or made as a segment and together with its cutting layer occupies only a portion of the supporting surface (3) of the carrier member (1), the remaining supporting surface being occupied by a supplementary member (6) of hard metal or other high-strength substances. With regard to the cutting performance and effect, the same requirements are met as with a circular diamond cutting plate while at the same time considerable savings are achieved in valuable diamond material.

2 Claims, 14 Drawing Figures

CUTTING MEMBER FOR ROTARY DRILL BIT

The invention relates to a cutting member for rotary drill bits for deep-well drilling and in particular to a cutting member consisting of a supporting member having a cutting layer or surface and which is supported by a hard metal carrier.

In known cutting members of this kind (U.S. Pat. No. 4,006,788), the supporting member together with its cutting layer consists of a small circular plate or shallow cylinder and the polycrystalline synthetic diamond material forming the cutting layer is applied to the supporting member by a sintering or hot infiltration process to form a rigid unit. The expensive diamond material causes by far the greatest proportion of the production costs of such diamond cutting plates. It is true that such cutting members are widely used for deep-well drilling on rotary drill bits, which have satisfactory drilling performances, but the drill bits equipped with diamond cutting members in this manner are very expensive because of the high price of the diamond material.

It is the object of the invention to provide a cutting member for rotary drill bits which has substantially the same cutting performance as the known cutting members but is considerably cheaper.

The present invention is a cutting member for rotary drill bits comprising a carrier member having a supporting surface, to which is connected a back surface of a supporting member of hard metal having on its front surface a cutting layer consisting of polycrystalline synthetic diamond material, and in which the supporting member together with its cutting layer occupies only a portion of the supporting surface of the carrier member and that the remaining supporting surface of the carrier member is occupied by a supplementary member of hard metal or other high-strength substances.

In the development according to the invention, the supporting member together with its diamond cutting layer is limited from the beginning only to that part of the supporting surface of the carrier member which alone performs the cutting work in practical drilling operation. The considerably cheaper supplementary member of hard metal, such as tungsten carbide for example, applied to the remaining supporting surface of the carrier member, serves as a rake, protects the carrier member and improves the support of the supporting member and its cutting layer. With regard to the cutting performance and effect of the cutting member according to the invention, this meets the same requirements as one with circular cutting plates, while important savings in valuable diamond material are achieved with function-related shaping of the cutting member. To this must be added the fact that unused residues of circular plates which have already been used can be used economically for the production of cutting members according to the invention.

Figure 13:
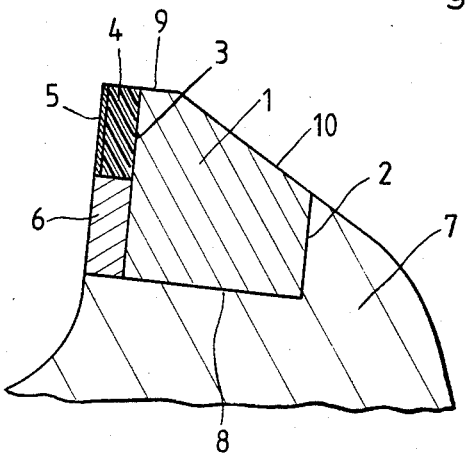
Figure 14:
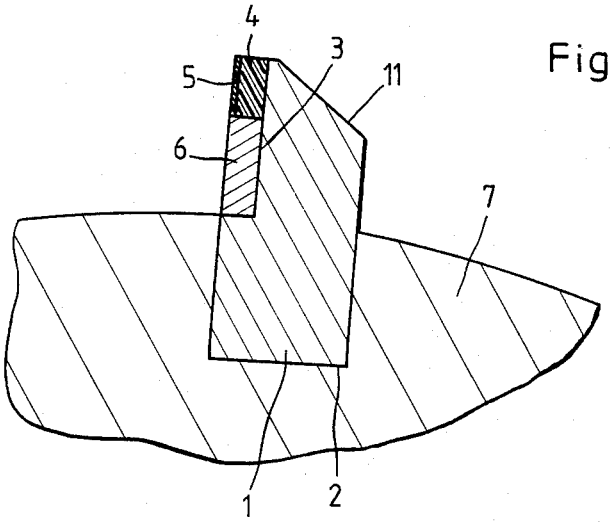

Embodiments of the present invention will now be described, by way of example, with reference to the accompanying drawings, in which:

FIGS. 1 and 2, 3 and 4, 5 and 6, 7 and 8, 9 and 10, and 11 and 12 each show an embodiment of a cutting member according to the invention in plan view in FIGS. 1, 3, 5, 7, 9, and 11 and in side view in FIGS. 2, 4, 6, 8, 10, and 12; and FIGS. 13 and 14 each show a further embodiment of a cutting member according to the invention in axial section when installed in a bit head.

The cutting member illustrated in the drawing comprises a carrier member 1 which has the shape of a shallow cylinder in the embodiments shown in FIGS. 1 to 6 and 9 to 12. The carrier member 1 has a circular base 2 and a supporting surface 3 parallel and coextensive with this for a supporting member 4 together with its cutting layer 5 and a supplementary member 6. The carrier member 1 and the supplementary member 6 consist of a suitable hard or sintered metal, for example tungsten carbide or the like. The supporting member 4 also consists of this material while the cutting layer 5 consists of a suitable diamond material, particularly polycrystalline synthetic diamond material, and is rigidly connected to the supporting member 4 using a hot infiltration process known per se.

The supporting member 4 together with its cutting layer 5 is cut, for example by spark erosion, out of a circular cylindrical shaped body which comprises the cutting layer on one surface and which can be formed by production methods known per se, and occupies only a portion of the plane, circular supporting surface 3 of the carrier member 1. Applied to the rest of the supporting surface of the carrier member 1 is the supplementary member 6 which has a shape which complements the supporting member 4 together with the cutting layer 5 to form a complete circular face. The supporting member 4 together with its cutting layer 5 in turn has the shape of a segment or a sector of a circle.

Figure 1:
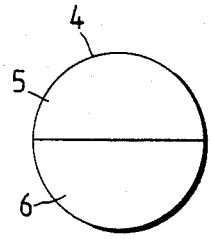
Figure 2:
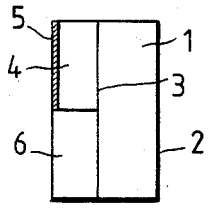

In the embodiment shown in FIGS. 1 and 2, both the supporting member 4 together with the cutting layer 5, and the supplementary member 6 have the shape of a semicircle in plan view.

Figure 3:
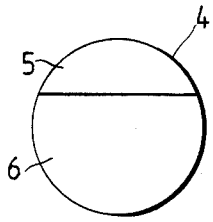
Figure 4:
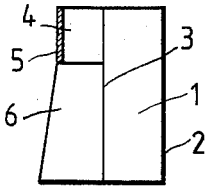

The embodiment shown in FIGS. 3 and 4 shows the supporting member 4 together with the cutting layer 5 as a segment of a circle in plan view, the supplementary member 6 occupying the remaining portion of the circle area.

Figure 5:
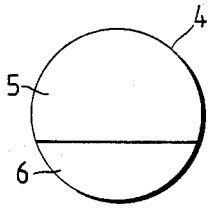
Figure 6:
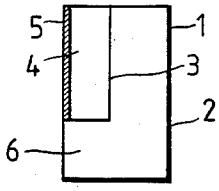

In the embodiment shown in FIGS. 5 and 6, conversely, the supplementary member 6 is made as a segment of a circle and the supporting member 4 together with the cutting layer 5 occupies the remaining portion of the circle area.

Figure 7:
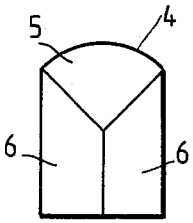
Figure 8:
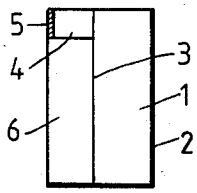

In the embodiment shown in FIGS. 7 and 8, the carrier member 1 has a basic shape bounded on three sides by straight lines and on one side by an arc of a circle with a corresponding shape of base 2 and supporting surface 3. In this example, the supporting member 4 together with the cutting layer 5 has the shape of a sector of a circle. The remaining portion of the supporting surface 3 of the carrier member 1 is occupied by the supplementary member 6 which, in this embodiment, is divided in the middle for manufacturing reasons, the surfaces of the parts of the supplementary member 6 lying in a common plane.

Figure 9:
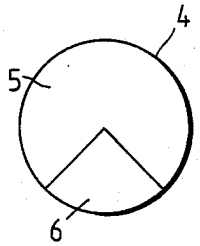
Figure 10:
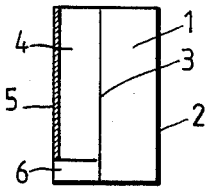
Figure 11:
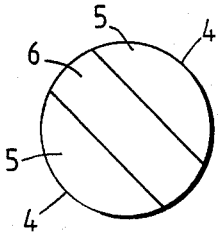
Figure 12:
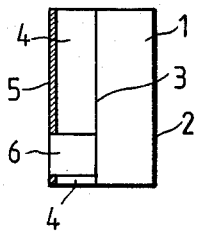

FIGS. 9 and 10 shows the supporting member 4 together with the cutting layer 5 as a circular area in plan view with a sector-shaped excision which is occupied by the supplementary member 6. Conversely, however, the supplementary member 6 may be made as a circular area in plan view with a cut-out sector which is occupied by the correspondingly sector-shaped supporting member 4 together with the cutting layer 5.

Finally a development is also possible wherein the supporting member 4 together with the cutting layer 5 consists of two or more portions of a circle, particularly disposed with spacing apart. As shown in FIG. 6, such a construction comprises, for example, two diametrically opposite segments of the supporting member 4 together with the cutting layer 5 which together with the supplementary member 6 disposed in between form a closed circle area in plan view.

In order to form the cutting member unit, the supporting member 4 may be rigidly connected, at its back opposite the cutting layer 5, to the supporting surface 3 of the carrier member 1 and at its boundary surface extending perpendicular to this to the adjacent boundary surface of the supplementary member 6 by a suitable soldered connection. In a corresponding manner, the supplementary member 6 can then be connected, at its back, to the carrier member 1 by such a soldered connection. Instead of this, a uniting of supporting member, supplementary member and carrier member can also be effected by form sintering or hot isostatic pressing.

Whereas in the examples of embodiment shown in FIGS. 1 and 5 to 14, the surface of the supplementary member 6 lies in one plane with that of the cutting layer 5 of the supporting member 4, a modification is also possible in such a manner that the surface of the supplementary member 6 rises in relation to the cutting layer 5 in a direction facing away from this, as FIGS. 3 and 4 show. As a result of this development, an improved removal of the formation chips drilled out in drilling operation can be achieved.

The supplementary member 6 which is further shown in general as a separate member, particularly a prefabricated shaped body, can also form a prefabricated unit with the carrier member 1, which unit can be produced by a shaping or machining operation and is illustrated in FIGS. 5 and 6. Fundamentally, it is also possible for the supplementary member 6 to be formed from an appropriately shaped region of a matrix binding-agent composition of the bit head in the state of the cutting member installed in a drill bit head.

Finally, in the embodiments illustrated in FIGS. 1 to 12, the back face formed jointly by the supporting member 4 together with the cutting layer 5 and by the supplementary member 6 overlies and is coextensive with the supporting surface 3 of the carrier member 1, and this in turn is parallel and coextensive with the base 2 of the carrier member 1 so that in the example shown in FIGS. 1 to 6 and 9 to 12, the cutting member as a whole has a circular cylindrical contour. This contour can be modified for example in the sense that the supporting surface 3 of the carrier member 1 is larger than the circle area formed jointly by the backs of the zupporting member 4 and of the supplementary member 6. Furthermore, the base 2 of the carrier member 1 may be larger or smaller than the supporting surface 3 in which cases the carrier member 1 has a frusto-conical shape.

Numerous modifications are also possible with regard to the configurations of the supporting member 4 together with the cutting layer 5 and of the supplementary member 6 selected in the embodiments illustrated, according to the intended use of the cutting member on the drill bit.

In the embodiment shown in FIG. 13, which shows the cutting member in a state installed in a bit head, an outer component region of a matrix binding-agent composition, for example on the basis of tungsten carbide, is illustrated at 7, in which the cutting member is inserted. In this embodiment, the carrier member 1 has a greater axial length than in the embodiments shown in FIGS. 1 to 12 and is supported by the matrix binding-agent composition 7 at its base 2 and at its inner generated surface 8. The supporting surface 3 of the carrier member 1 is circular and congruent with the circle area formed jointly by the supporting member 4 together with the cutting layer 5 and by the supplementary member 6. The supporting member 4 together with the cutting layer 5 and the supplementary member 6 each have substantially the semicircular shape as shown in FIG. 1. The outer surface or outer generated surface 9 of the carrier member 1 bordering on the back of the supporting member 4 is provided with a substantially plane bevel 10 towards the base 2 of the carrier member 1, which is in alignment with the outer face of the matrix binding-agent composition 7.

In the embodiment shown in FIG. 14 the matrix binding-agent composition of the drill bit head is again illustrated at 7 in which the carrier member 1 is inserted in the form of an elongated substantially cylindrical carrier pin with a base 2 as a bearing surface. In this case, the carrier member 1 may be provided, at its end region engaging in the matrix 7, with flattened portions which locate it against rotary movements about its longitudinal axis. In this embodiment, the supporting surface 3 of the carrier member 1 is formed by a plane flattened portion in a region of its generated surface projecting outwards beyond the matrix 7. In its region connected to the supporting member 4, the supporting surface 3 has the shape of part of a circle, for example a segment of a circle, and the supporting member 4 together with its cutting layer 5 has a corresponding divided-circle or segment of a circle shape. The supplementary member 6, which extends to the axial direction of the carrier member 1 substantially as far as the outer face of the matrix 7, can, on the other hand, have a rectangular or square shape such as results for the supporting surface 3 in the region of the supplementary member 6 with a plane segment of the generated surface of the cylindrical carrier member 1. In this embodiment, the end 11 of the carrier member 1 is again bevelled towards its base 2 or towards the matrix 7.

When the cutting members are used in a drill bit, substantially in the arrangement and formation as shown in FIGS. 13 and 14, the drilling progress decreases very rapidly when the supporting member 4 together with its cutting layer 5 is worn down to the supplementary member 6. This clearly recognizable, more or less immediate reduction in the drilling progress distinguishes the state of wear of the cutting members, the arrangement of which in the drill bit head may be such that in the state of the cutting members worn down to the supplementary member 6, the matrix 7 of the drill bit is still undamaged and the drill bit can be repaired again by exchanging the cutting members. In contrast to this, a drill bit equipped in a comparable manner with diamond cutting plates in the form of a complete circle achieves a substantially constant drilling progress until the bit head rests completely on the bottom of the borehole, so that the matrix 7 is damaged and reconditioning of the bit head is no longer possible.

Through the bevelling of the generated surface 9 or the end face 11 of the carrier member 1 provided in the embodiments shown in FIGS. 13 and 14, comparatively small contact surfaces result which slide on the bottom of the borehole in drilling operation so that a smaller braking moment is produced as a result. Thus when drilling with a direct bit drive, a higher speed of rotation and consequently a greater drilling progress is possible.

What is claimed is:

1. A cutting member for rotary drill bits comprising a carrier member having a supporting surface, to which is connected a back surface of a supporting member of hard metal having on its front surface a cutting layer having an exposed front surface and a cutting edge and consisting of polycrystalline synthetic diamond material, and in which the supporting member together with its cutting layer occupies only a portion of the supporting surface of the carrier member and that the remaining supporting surface of the carrier member is occupied by supplementary member of hard metal or other high-strength substances having a free exposed front surface extending the front surface of the cutting member and in which the supplementary member has a shape which complements the supporting member together with the cutting layer to form a complete circular face.

2. A cutting member as claimed in claim 1 in which the surface of the supplementary member is coplanar with that of the cutting layer.

* * * * *